US010189486B2

(12) United States Patent
Brown et al.

(10) Patent No.: US 10,189,486 B2
(45) Date of Patent: Jan. 29, 2019

(54) RAILCAR WITH NESTED SLIDING GATES

(71) Applicant: Trinity North American Freight Car, Inc., Dallas, TX (US)

(72) Inventors: Andrew Brown, Plano, TX (US); Kenneth W. Huck, Fairview, TX (US)

(73) Assignee: Trinity North American Freight Car, Inc., Dallas, TX (US)

( * ) Notice: Subject to any disclaimer, the term of this patent is extended or adjusted under 35 U.S.C. 154(b) by 195 days.

(21) Appl. No.: 15/406,465

(22) Filed: Jan. 13, 2017

(65) Prior Publication Data

US 2018/0201278 A1 Jul. 19, 2018

(51) Int. Cl.
*B61D 7/00* (2006.01)
*B61D 7/02* (2006.01)

(52) U.S. Cl.
CPC ..... *B61D 7/02* (2013.01)

(58) Field of Classification Search
CPC ... B61D 7/00; B61D 7/02; B61D 7/04; B61D 7/20; B61D 19/00
See application file for complete search history.

(56) References Cited

U.S. PATENT DOCUMENTS

| | | | | | |
|---|---|---|---|---|---|
| 1,703,756 | A * | 2/1929 | Wine | B61D 7/00 | 105/249 |
| 5,238,333 | A * | 8/1993 | Dugge | B65D 90/623 | 105/247 |
| 2014/0366770 | A1* | 12/2014 | Klinkenberg | B61D 7/22 | 105/247 |
| 2015/0000555 | A1* | 1/2015 | Klinkenberg | B61D 7/26 | 105/282.2 |
| 2015/0298709 | A1* | 10/2015 | Senn | B61D 7/26 | 105/282.3 |
| 2018/0201278 | A1* | 7/2018 | Brown | B61D 7/02 | |
| 2018/0201279 | A1* | 7/2018 | Huck | B61D 7/28 | |

* cited by examiner

*Primary Examiner* — Jason C Smith
(74) *Attorney, Agent, or Firm* — Baker Botts, LLP

(57) ABSTRACT

A railcar system that includes a railcar and a nested sliding gate assembly disposed within the railcar. The nested sliding gate assembly includes an upper deck, a lower deck, and a driving system. The upper deck has a plurality of holes. The lower deck is positioned below the upper deck and has a plurality of discharge ports. The driving system positions the lower deck in a first position with respect to the upper deck, where the holes of the upper deck and the discharge ports of the lower deck do not align when the lower deck is in the first position. The driving system also positions the lower deck in a second position with respect to the upper deck, where the holes of the upper deck and the discharge ports of the lower deck at least partially align when the lower deck is in the second position.

20 Claims, 4 Drawing Sheets

RAILCAR WITH NESTED SLIDING GATES

TECHNICAL FIELD

This disclosure relates generally to railcars and more particularly to railcars which discharge cargo or lading, such as coal, ore, ballast, grain, and any other lading suitable for transport in railcars.

BACKGROUND

Railway hopper cars with one or more hoppers are used for transporting commodities such as dry bulk. For example, hopper cars are frequently used to transport coal, sand, metal ores, ballast, aggregates, grain, and any other type of lading material. Commodities are discharged from openings typically located at or near the bottom of a hopper. Existing systems use a door or gate assembly to open and close discharge openings of a hopper. Existing gate assemblies have limited flow rates which limits how quickly a commodity can be unloaded from a railcar.

Existing gate assemblies typically feature a mechanically operated slide whose travel in the longitudinal centerline of the car dictates the minimum distance apart the gate assemblies may be located. This is considered during the car design, where two sides are traveling towards each other. In addition, historical unloading infrastructure of some locations has dictated the spacing of the gate assemblies, where current day facilities offer a discharge pit in such length as a full car length, providing unloading flexibility options. Thus, it is desirable to provide a discharge system which is not constrained to outdated requirements, takes full advantage of current infrastructure flexibility, and offers improved overall system efficiencies to transport commodities.

SUMMARY

In one embodiment, the disclosure includes a railcar system that includes a railcar and a nested sliding gate assembly disposed within the railcar. The nested sliding gate assembly includes an upper deck, a lower deck, and a driving system. The upper deck has a plurality of holes. The lower deck positioned below the upper deck and has a plurality of discharge ports. The driving system is connected to the lower deck. The driving system positions the lower deck in a first position with respect to the upper deck, where the holes of the upper deck and the discharge ports of the lower deck do not align when the lower deck is in the first position. The driving system also positions the lower deck in a second position with respect to the upper deck, where the holes of the upper deck and the discharge ports of the lower deck at least partially align when the lower deck is in the second position.

In another embodiment, the disclosure includes a railcar discharging method. The method includes positioning a railcar comprising a nested sliding gate assembly in a first configuration. The nested sliding gate assembly has an upper deck with a plurality of holes out of alignment with a plurality of discharge ports of a lower deck when the nested sliding gate assembly is in the first configuration. The method further includes operating a driving system to transition the nested sliding gate assembly from the first configuration to a second configuration. The holes are at least partially aligned with the discharge ports when the nested sliding gate assembly is in the second configuration.

Various embodiments present several technical advantages, such as providing a nested sliding gate assembly that allows a railcar (e.g. a hopper car) to employ a variable discharge flowrate when unloading a commodity from the railcar. The nested sliding gate assembly provides the ability for a railcar to adjust its discharge flowrate between 0-100% of a maximum discharge flowrate. This provides more flexibility than existing systems that can only be configured to with either a 0% discharge flowrate (i.e. fully closed) or a 100% discharge flowrate (i.e. fully open). In addition, the nested sliding gate assembly allows the railcar to partially unload the railcar by temporarily configuring the nested sliding gate assembly in a configuration to discharge the commodity from the railcar and then configuring the nested sliding gate assembly to another configuration to discontinue discharging the commodity from the railcar.

Certain embodiments of the present disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Disclosed herein are various embodiments of a nested sliding gate assembly that provides a variable discharge flowrate for a railcar (e.g. a covered or open hopper). A nested sliding gate assembly comprises a plurality of sliding decks that can be shifted with respect to each other. Each deck comprises a plurality of holes. The nested sliding gate assembly adjusts the position of the sliding decks with respect to each other in order to control the discharge rate of a commodity. For example, the nested sliding gate assembly positions the sliding decks such that the holes from each deck are not aligned to prevent a commodity from being discharged from a railcar. The nested sliding gate assembly positions the sliding decks such that the holes from each deck are at least partially aligned to allow a commodity to be discharged from the railcar. By adjusting the alignment of the holes, the nested sliding gate assembly can adjust the discharge rate of a commodity. Unlike existing systems that have a binary flowrate (i.e. fully open or fully closed), the nested sliding gate assembly provides a variable flowrate by allowing partial to full hole alignment when discharging a commodity.

Figure 1:
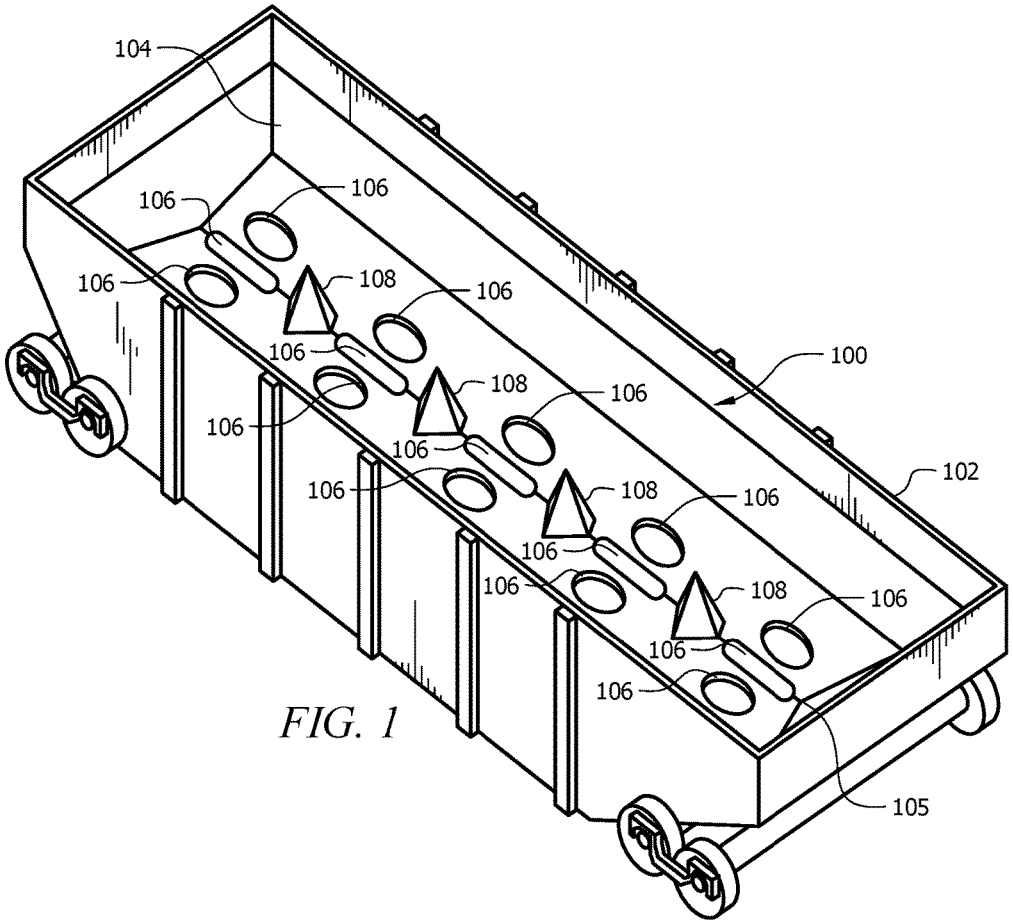
FIG. 1 is a perspective view of an embodiment of a railcar with a nested sliding gate assembly.

FIG. 1 is a perspective view of an embodiment of a railcar 102 with a nested sliding gate assembly 100. The railcar 102 is configured to carry and transport bulk materials such as coal, lading material, sand, grain, metal ores, aggregate, ballast, and/or any other suitable type of material. In one embodiment, the railcar 102 is configured with an open top and bottom discharge openings or outlets. In other embodiments, the railcar 102 may be a gondola car, an open hopper car, a closed hopper car, or another suitable type of railcar.

In one embodiment, the nested sliding gate assembly 100 is disposed at or near the bottom portion of the railcar 102. The nested sliding gate assembly 100 is configured to allow commodities to be discharge from the railcar 102 via one or more discharge ports (not shown). For example, the nested sliding gate assembly 100 is configured to slide one or more decks of the nested sliding gate assembly 100 to allow commodities to discharge from the railcar 102 progressively. The nested sliding gate assembly 100 controls the relative position of holes on each deck to adjust the discharge flowrate.

The nested sliding gate 100 assembly comprises a plurality of decks including an upper deck 104. In one embodiment, the upper deck 104 is configured with a longitudinal valley or trench 105 along the length the of the railcar 102. The upper deck 104 may comprise curved or sloped surfaces configured to allow commodities to settle in the valley or trench 105 formed by the surfaces of the upper deck 104. For example, the upper deck 104 may be V-shaped with a trench 105 that runs the length of the center of the railcar 102. In one embodiment, the upper deck 104 is permanently or semi-permanently attached to the railcar 102 in a fixed position with respect to the railcar 102.

In one embodiment, the upper deck 104 comprises a plurality of holes 106 and a plurality of deflectors 108. The holes 106 are configured to allow a commodity to pass through the upper deck 104 when the holes 106 are at least partially aligned with a discharge port. The deflectors 108 are configured to guide commodities towards one or more holes 106 as the commodities shift downward into the trench 105. Additional information about the nested sliding gate assembly 100 is described in FIGS. 2, 3, 4A, 4B, and 5.

Figure 2:
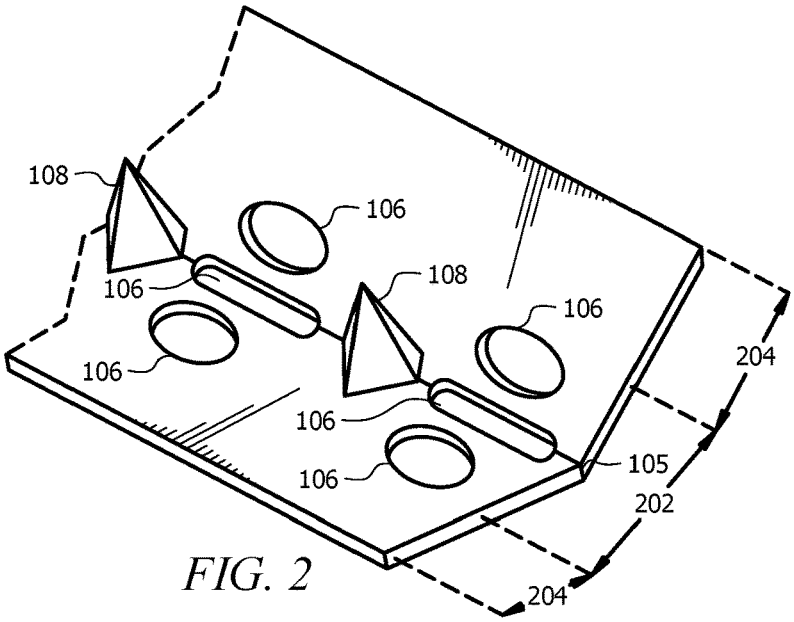
FIG. 2 is a perspective view of an embodiment of a portion of an upper deck of a nested sliding gate assembly.

FIG. 2 is a perspective view of an embodiment of a portion of an upper deck 104 of a nested sliding gate assembly 100. The holes 106 may be slots, circular openings, ovular openings, or any other suitable shape opening in the upper deck 104. The holes 106 may be any suitable size to allow a commodity to pass through the upper deck 104 when the holes 106 are at least partially aligned with discharge ports (not shown) on another deck. The deflectors 108 may be cone shaped, pyramid shaped, diamond shaped, or any other suitable shape for deflecting commodities to one or more holes 106 of the upper deck 104. In other embodiments, the upper deck 104 may comprise any other suitable pattern, number, or type of holes 106 and/or deflectors 108.

In one embodiment, the upper deck 104 is configured with the holes 106 and deflectors 108 are positioned adjacent to each other within a central portion 202 of the upper deck 104 and along the trench 105 of the upper deck 104. The upper deck 104 may be configured such that there are no holes 106 in upper portions 204 of the upper deck 104. In other words, the upper deck 104 is configured to limit where a commodity discharges to just along the central 202 portion of the upper deck 104. By limiting the where the commodity is able to discharge from, the nested sliding gate assembly 100 is able to control where the commodity is discharged from the railcar 102. For example, the nested sliding assembly 100 is configured such that a commodity is discharged within an area between the wheels of the railcar 102. In this example, the nested sliding gate assembly 100 is configured to allow the railcar 102 to discharge a commodity onto a track without substantially spilling the commodity outside of the track. In other embodiments, the holes 106 may be in any other suitable location on the upper deck 104.

Figure 3:
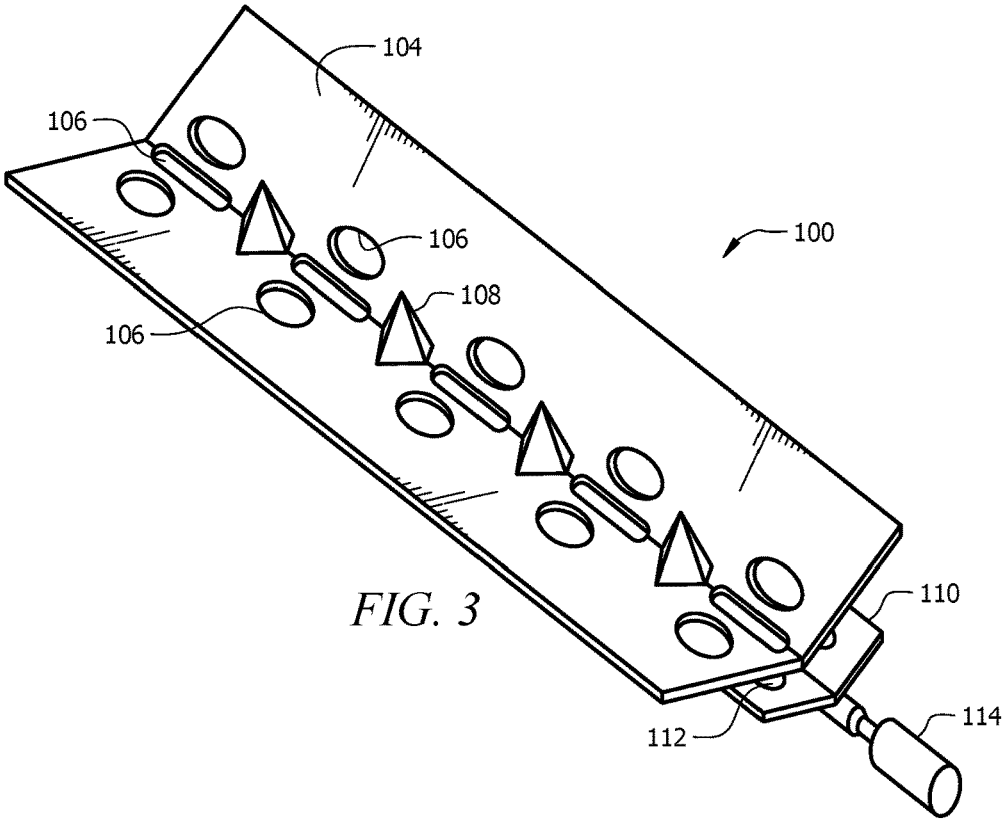
FIG. 3 is a perspective view of an embodiment of a nested sliding gate assembly.

FIG. 3 is a perspective view of an embodiment of a nested sliding gate assembly 100. The nested sliding gate assembly 100 comprises the upper deck 104, a lower deck 110 comprising a plurality of discharge ports 112, and a driving system 114. The upper deck 104 is configured similar to the upper deck 104 described in FIGS. 1 and 2.

The lower deck 110 is disposed below the upper deck 104. The lower deck 110 is configured to be moveable or repositionable with respect to the upper deck 104 and the railcar 102. The lower deck 110 is configured to allow a commodity to discharge when the holes 106 of the upper deck 104 are at least partially aligned with the discharge ports 112 of the lower deck 110. The discharge ports 112 may be slots, circular openings, ovular openings, or any other suitable shape opening in the lower deck 110. The discharge ports 112 may be any suitable size to allow a commodity to pass from the upper deck 104 and through the lower deck 110 when the holes 106 are at least partially aligned with discharge ports 112. In one embodiment, the discharge ports 112 are configured to have a similar shape and/or size as a corresponding hole 106 on the upper deck 104. For example, a discharge port 112 may have a circular shape that corresponds with a hole 106 on the upper deck 104.

In other embodiments, the lower deck 110 comprises any other configuration of discharge ports 112. For example, the lower deck 110 may comprise a first set of discharge ports 112 that are about the same size as the holes 106 of the upper deck 104 and a second set of discharge ports 112 that are smaller then the holes 106 of the upper deck 104. In this example, the nested sliding gate assembly 100 aligns either the first set of discharge ports 112 or the second set of discharge ports 112 with the holes 106 of the upper deck 104 to adjust the discharge flowrate of a commodity. When the discharge ports 112 have a smaller size than the holes 106 of the upper deck 104, the discharge flowrate is less than when the discharge ports 112 are about the same size as the holes 106 of the upper deck 104.

The driving system 114 is operably coupled to the lower deck 106 and is configured to move the lower deck 110 with respect to the upper deck 104. In one embodiment, the driving system 114 is configured to move the lower deck 110 longitudinally with respect to the upper deck 104. In another embodiment, the driving system 114 is configured to move the lower deck 110 laterally with respect to the upper deck 104. In another embodiment, the driving system 114 is configured to move the lower deck 110 in a transverse direction. For example, the lower deck 110 may be formed from two separate plates configured to form a V-shape. The driving system 114 is configured to moved each plate transversely away from each other to align the discharge ports 112 with the holes 106. In other embodiments, the driving system 114 is configured to move the lower deck 110 in any other direction or combination of directions with respect to the upper deck 104.

The driving system 114 may comprise a pneumatic cylinder, a hydraulic cylinder, a motor, levers, gears, capstans, cables, ropes, or any other suitable devices configured to move the lower deck 110 longitudinally with respect to the upper deck 104. For example, the driving system 114 may be a pneumatic cylinder configured to move the lower deck 104 in response to the application of an air pressure to a port of the pneumatic cylinder.

In FIG. 3, the nested sliding gate assembly 100 comprises one lower deck 110. In other embodiments, the nested sliding gate assembly 100 comprises a plurality of lower decks 110 configured similar to as previously described. For example, the nested sliding gate assembly 100 comprises two or more lower decks 110 configured to allow a commodity to discharge when the holes 106 of the upper deck 104 are at least partially aligned with the discharge ports 112 of the lower decks 110.

Figure 4A:
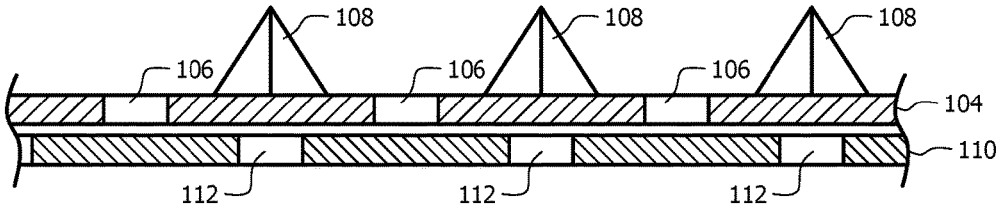
FIGS. 4A and 4B are partial cutaway side views of an embodiment of a nested sliding gate assembly in various stages of operation.
Figure 4B:
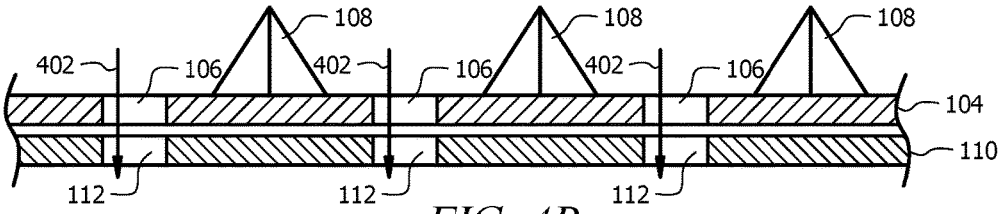

FIGS. 4A and 4B are partial cutaway side views of an embodiment of a nested sliding gate assembly 100 in various stages of operation. FIGS. 4A and 4B show the nested sliding gate assembly 100 in different configurations that either prevent or allow a commodity to be discharged from a railcar 102.

FIG. 4A shows the nested sliding gate assembly 100 in a first configuration that substantially prevents a commodity from being discharged from a railcar 102. In FIG. 4A, the upper deck 104 and the lower deck 110 are positioned with respect to each other such that the holes 106 of the upper deck 104 do not align with the discharge ports 112 of the lower deck 110. In this example, a flow path through the upper deck 104 and the lower deck 110 is obstructed when the holes 106 of the upper deck 104 do not align with the discharge ports 112 of the lower deck 110.

FIG. 4B shows the nested sliding gate assembly 100 in a second configuration that allows a commodity to be discharged from a railcar 102. In FIG. 4B, the upper deck 104 and the lower deck 110 are positioned with respect to each other such that the holes 106 of the upper deck 104 substantially align with the discharge ports 112 of the lower deck 110. In this example, flow paths 402 through the upper deck 104 and the lower deck 110 is formed when the holes 106 of the upper deck 104 at least partially align with the discharge ports 112 of the lower deck 110. The flow paths 402 allow the commodity to discharge from the interior of the railcar 102 via the holes 106 and the discharge ports 112.

In this example, the holes 106 and the discharge ports 112 are about the same size and fully aligned which may provide the maximum discharge flowrate. In another example, the holes 106 and the discharge ports 112 may be partially aligned and/or have different sizes to provide a lower discharge flowrate.

Figure 5:
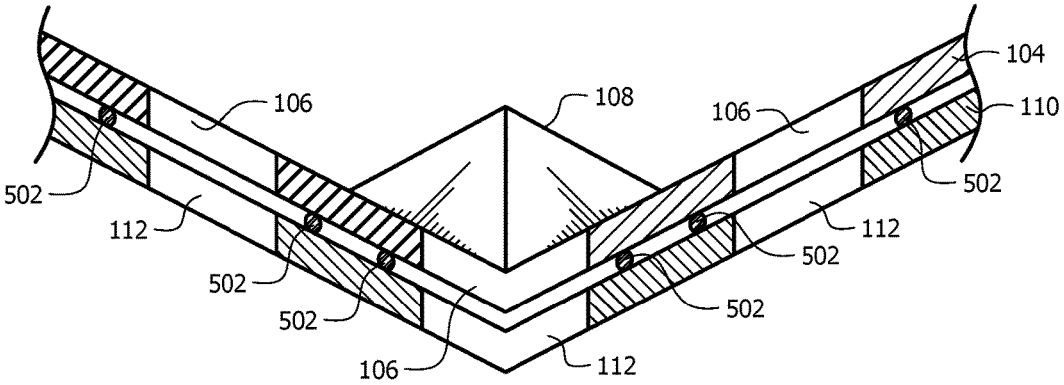
FIG. 5 is an end view of an embodiment of a nested sliding gate assembly.

FIG. 5 is an end view of an embodiment of a nested sliding gate assembly 100. In one embodiment, the nested sliding gate assembly 100 comprises a plurality of seals 502 disposed between the upper deck 104 and the lower deck 110. The seals 502 may be configured to assist with allowing the lower deck 110 to be positioned with respect to the upper deck 104, for example, by reducing the amount of a commodity that can become trapped between the upper deck 104 and the lower deck 110.

Seals 502 may be formed of rubber, elastomers, ultra-high-molecular-weight polyethylene, composites, and/or any other suitable material. The nested sliding gate assembly 100 may comprise any suitable number and type of seals 502 as would be appreciated by one of ordinary skill in the art. For examples, the seals 502 may be positioned as shown in FIG. 5 or in any other suitable configuration.

Figure 6:
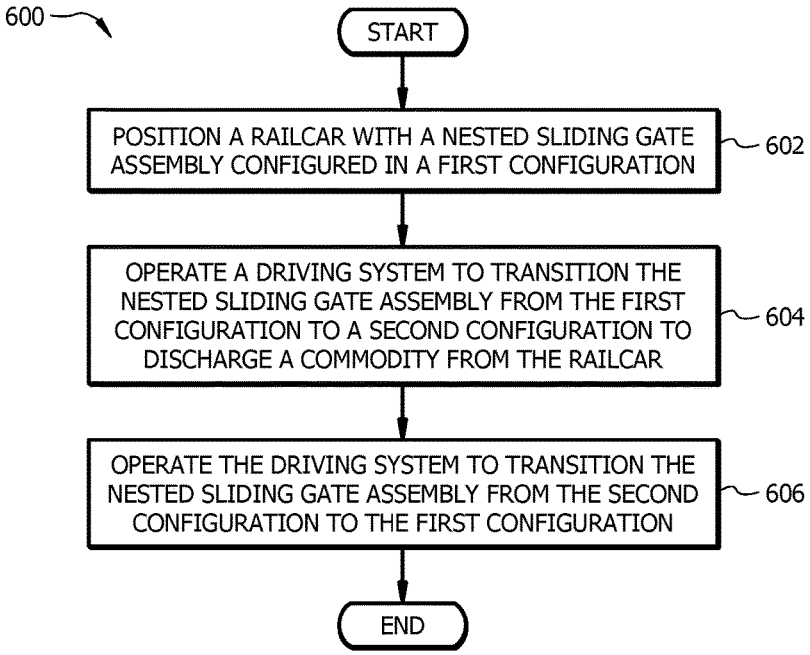
FIG. 6 is a flowchart of an embodiment of a railcar discharging method.

FIG. 6 is a flowchart of an embodiment of a railcar discharging method 600. In an embodiment, an operator or controller (e.g. a microcontroller or control system) may employ method 600 to control discharge a commodity from a railcar 102. For example, an operator may operate the nested sliding gate assembly 100 to control the discharge flowrate of the railcar 102 while unloading the railcar 102.

At step 602, the operator positions the railcar 102 with the nested sliding gate assembly 100 configured in the first configuration. For example, the operator may position the railcar 102 at or proximate to a site where the commodity the railcar 102 is carrying can be unloaded. When the nested sliding gate assembly 100 is in the first configuration, the nested sliding gate assembly 100 is configured to substantially disallow the commodity from being discharged from the railcar 102.

At step 604, the operator operates a driving system 114 to transition the nested sliding gate assembly 100 from the first configuration to a second configuration to discharge a commodity from the railcar 102. For example, when the driving system 114 comprises a pneumatic cylinder, the operator applies an air pressure to an inlet port of the pneumatic cylinder causing the lower deck 110 to move 104 relative to the upper deck 104. As another example, when the driving system 114 comprises a capstan, the operator may manually operate the driving system 114 to move the lower deck 110 relative to the upper deck 104. As another example, when the driving system 114 comprises a motor and gear assembly, the operator may operate the motor to move the lower deck 110 relative to the upper deck 104. In other examples, the operator may use any other suitable device or technique to move the lower deck 110 relative to the upper deck 104.

The railcar 102 begins to discharge when the holes 106 of the upper deck 104 at least partially align with the discharge ports 112 of the lower deck 110. The nested sliding gate assembly 100 allows the operator to adjust the discharge flowrate of the railcar 102. In one embodiment, the operator controls the discharge flowrate of the commodity by controlling the alignment of the holes 106 of the upper deck 104 and the discharge ports 112 of the lower deck 110. For example, the railcar 102 discharges at a relatively low discharge flowrate when the holes 106 and the discharge ports 112 are only partially aligned. The railcar 102 discharges at a relatively higher discharge flowrate when the holes 106 and the discharge ports 112 are substantially aligned.

In another embodiment, the operator controls the discharge flowrate of the commodity by aligning the holes 106 with different size discharge ports 112. For example, the railcar 102 discharges at a relatively low discharge flowrate when the discharge ports 112 aligned with the holes 106 are smaller than the holes 106. The railcar 102 discharges at a relatively higher discharge flowrate when the discharge ports 112 are aligned with the holes 106 that are similar in size (e.g. the same size) as the holes 106. In other embodiments, the operator may employ any combination of alignment and sizing between the holes 106 and the discharge ports 112 to control the discharge flowrate of the commodity from the railcar 102.

At step 606, the operator operates the driving system 114 to transition the nested sliding gate assembly 100 from the second configuration to the first configuration. For example, the operator operates the driving system 114 to position the lower deck 110 such that the holes 106 of the upper deck 104 are not aligned with the discharge ports 112 of the lower deck 110. Transitioning the nested sliding gate assembly 100 to the first configuration discontinues the unloading of the commodity from the railcar 102. The operator may pause the unloading of a commodity, reposition railcar 102, refill the railcar 102 with a commodity, or perform any other operation on the railcar 102 when the nested sliding gate assembly 100 is in the first configuration.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

The invention claimed is:

1. A railcar system comprising:
a railcar; and
a nested sliding gate assembly disposed within the railcar, and comprising:
an upper deck comprising a plurality of holes;
a lower deck positioned below the upper deck, and comprising a plurality of discharge ports; and
a driving system operably coupled to the lower deck, wherein:
the driving system is configured to position the lower deck in a first position with respect to the upper deck,
the holes of the upper deck and the discharge ports of the lower deck do not align when the lower deck is in the first position,
the driving system is configured to position the lower deck in a second position with respect to the upper deck, and
the holes of the upper deck and the discharge ports of the lower deck at least partially align when the lower deck is in the second position.

2. The system of claim 1, wherein the driving system is configured to adjust the alignment of the holes and discharge ports to adjust a discharge flowrate.

3. The system of claim 1, wherein:
the plurality of discharge ports comprises a first set of discharge ports and a second set of discharge ports smaller than the first set of discharge ports,
the driving system is configured to position the lower deck to align the first set of discharge ports with the holes to provide a first discharge flowrate, and
the driving system is configured to position the lower deck to align the second set of discharge ports with the holes to provide a second discharge flowrate less than the first discharge flowrate.

4. The system of claim 1, wherein the upper deck comprises a plurality of deflectors adjacent to the plurality of holes.

5. The system of claim 1, wherein:
the upper deck comprises:
a pair of sloped surfaces, and
a trench between the sloped surfaces;
the holes are positioned along the trench.

6. The system of claim 1, wherein the lower deck is configured to move longitudinally with respect to the upper deck.

7. The system of claim 1, wherein:
the holes are positioned along a center portion of the upper deck, and
at least a portion of the upper deck adjacent to the center portion of the upper deck does not comprise holes.

8. A railcar discharging method comprising:
positioning a railcar nested sliding gate assembly in a first configuration, wherein the nested sliding gate assembly comprises an upper deck comprising a plurality of holes out of alignment with a plurality of discharge ports of a lower deck when the nested sliding gate assembly is in the first configuration;
operating a driving system to transition the nested sliding gate assembly from the first configuration to a second configuration, wherein the plurality of holes are at least partially aligned with the plurality of discharge ports when the nested sliding gate assembly is in the second configuration.

9. The method of claim 8, wherein operating the driving system comprises adjusting the alignment of the holes and the discharge ports to adjust a discharge flowrate.

10. The method of claim 8, wherein:
the plurality of discharge ports comprises a first set of discharge ports and a second set of discharge ports smaller than the first set of discharge ports; and
operating the driving system comprises:
aligning the first set of discharge ports with the holes to provide a first discharge flowrate, and
aligning the second set of discharge ports with the holes to provide a second discharge flowrate less than the first discharge flowrate.

11. The method of claim 8, wherein the holes are positioned along a trench between sloped surfaces of the upper deck.

12. The method of claim 8, wherein operating the driving system comprise moving the lower deck longitudinally with respect to the upper deck.

13. The method of claim 8, wherein the holes are positioned along a center portion of the upper deck, and
at least a portion of the upper deck adjacent to the center portion of the upper deck does not comprise holes.

14. An apparatus comprising:
an upper deck comprising a plurality of holes;
a lower deck positioned below the upper deck, and comprising a plurality of discharge ports; and
a driving system operably coupled to the lower deck, wherein:
the driving system is configured to position the lower deck in a first position with respect to the upper deck,
the holes of the upper deck and the discharge ports of the lower deck do not align when the lower deck is in the first position,
the driving system is configured to position the lower deck in a second position with respect to the upper deck, and
the holes of the upper deck and the discharge ports of the lower deck at least partially align when the lower deck is in the second position.

15. The apparatus of claim 14, wherein the driving system is configured to adjust the alignment of the holes and discharge ports to adjust a discharge flowrate.

16. The apparatus of claim 14, wherein:

the plurality of discharge ports comprises a first set of discharge ports and a second set of discharge ports smaller than the first set of discharge ports, the driving system is configured to position the lower deck to align the first set of discharge ports with the holes to provide a first discharge flowrate, and the driving system is configured to position the lower deck to align the second set of discharge ports with the holes to provide a second discharge flowrate less than the first discharge flowrate.

17. The apparatus of claim 14, wherein the upper deck comprises a plurality of deflectors adjacent to the plurality of holes.

18. The apparatus of claim 14, wherein the lower deck is configured to move longitudinally with respect to the upper deck.

19. The apparatus of claim 14, wherein:

the upper deck comprises:

a pair of sloped surfaces, and a trench between the sloped surfaces;

the holes are positioned along the trench.

20. The apparatus of claim 14, wherein:

the holes are positioned along a center portion of the upper deck, and at least a portion of the upper deck adjacent to the center portion of the upper deck does not comprise holes.

* * * * *